US010710841B2

(12) United States Patent
Steinhauer et al.

(10) Patent No.: US 10,710,841 B2
(45) Date of Patent: Jul. 14, 2020

(54) METHOD FOR OPERATING AN ELEVATOR SYSTEM AND ELEVATOR SYSTEM DESIGNED FOR PERFORMING THE METHOD

(71) Applicants: ThyssenKrupp Elevator AG, Essen (DE); ThyssenKrupp AG, Essen (DE)

(72) Inventors: Eduard Steinhauer, Nürtingen (DE); Matthias Glück, Hochdorf (DE); Bankole Adjibadji, Nürtingen (DE)

(73) Assignees: ThyssenKrupp Elevator AG, Essen (DE); thyssenkrupp AG, Essen (DE)

( * ) Notice: Subject to any disclaimer, the term of this patent is extended or adjusted under 35 U.S.C. 154(b) by 551 days.

(21) Appl. No.: 15/530,000

(22) PCT Filed: Nov. 10, 2015

(86) PCT No.: PCT/EP2015/076141
§ 371 (c)(1),
(2) Date: Aug. 31, 2017

(87) PCT Pub. No.: WO2016/083115
PCT Pub. Date: Jun. 2, 2016

(65) Prior Publication Data

US 2017/0355553 A1 Dec. 14, 2017

(30) Foreign Application Priority Data

Nov. 27, 2014 (DE) ..... 10 2014 017 487

(51) Int. Cl.
*B66B 1/00* (2006.01)
*B66B 1/24* (2006.01)
(Continued)

(52) U.S. Cl.
CPC ..... *B66B 1/2466* (2013.01); *B66B 1/3415* (2013.01); *B66B 1/3446* (2013.01);
(Continued)

(58) Field of Classification Search
CPC ..... B66B 2201/301; B66B 1/2433; B66B 2201/213; B66B 2201/225; B66B 13/14;
(Continued)

(56) References Cited

U.S. PATENT DOCUMENTS 5,877,462 A 3/1999 Chenais
2005/0189181 A1* 9/2005 Meyle ..... B66B 1/2458 187/382

(Continued)

FOREIGN PATENT DOCUMENTS

CN 2693728 4/2005
CN 1868849 A 11/2006

(Continued)

OTHER PUBLICATIONS

Korean Office Action for KR Application No. 10-2017-701528 dated Feb. 22, 2019, 6 pages.

(Continued)

*Primary Examiner* — Marlon T Fletcher
(74) *Attorney, Agent, or Firm* — RMCK Law Group PLC

(57) ABSTRACT

The present disclosure concerns a method for operating an elevator system which comprises a shaft system and at least three cars, which is designed for separately moving the cars in at least a first direction of travel and in a second direction of travel. The at least three cars are moved separately in sequential operation each time and for each car a stop point at which the car can stop if necessary is continuously predicted at least for one direction of travel. The distance of the predicted stop points of neighboring cars from each other is thereby continuously determined. The elevator system is transferred to a safety mode if a negative distance of the stop points is determined.

19 Claims, 2 Drawing Sheets

(51) Int. Cl.

| | |
|---|---|
| ***B66B 5/00*** | (2006.01) |
| ***B66B 1/34*** | (2006.01) |
| ***B66B 5/02*** | (2006.01) |
| ***B66B 9/00*** | (2006.01) |

(52) U.S. Cl.
CPC ..... *B66B 5/0031* (2013.01); *B66B 5/02* (2013.01); *B66B 9/003* (2013.01); *B66B 2201/30* (2013.01)

(58) Field of Classification Search
CPC ..... B66B 1/36; B66B 2201/231; B66B 2201/303; B66B 7/06; B66B 7/1215; B66B 11/0095; B66B 13/143; B66B 1/2491; B66B 11/0213; B66B 5/28; B66F 9/063; B66F 9/0755
See application file for complete search history.

(56) References Cited

U.S. PATENT DOCUMENTS

| | | | |
|---|---|---|---|
| 2005/0279584 | A1 | 12/2005 | Reuter et al. |
| 2006/0249335 | A1 | 11/2006 | Yoshikawa et al. |
| 2008/0060882 | A1 | 3/2008 | Nuebling |
| 2009/0277724 | A1 | 11/2009 | Thumm et al. |
| 2013/0299282 | A1 | 11/2013 | Kugiya et al. |
| 2017/0233218 | A1* | 8/2017 | Zheng ..... B66B 1/2491 187/247 |
| 2017/0327345 | A1* | 11/2017 | Steinhauer ..... B66B 5/02 |
| 2017/0355553 | A1* | 12/2017 | Steinhauer ..... B66B 1/3446 |
| 2018/0201472 | A1* | 7/2018 | Gerstenmeyer ..... B66B 9/003 |

FOREIGN PATENT DOCUMENTS

| | | | |
|---|---|---|---|
| CN | 101100257 | A | 1/2008 |
| EP | 0769469 | A1 | 4/1997 |
| EP | 1562848 | A1 | 8/2005 |
| EP | 2022742 | A1 | 2/2009 |
| EP | 1876134 | A3 | 6/2012 |
| EP | 1719727 | B1 | 4/2013 |
| JP | H09110316 | A | 4/1997 |
| KR | 20070106748 | A | 11/2007 |
| KR | 20130135909 | A | 12/2013 |
| WO | 2004043842 | A1 | 5/2004 |

OTHER PUBLICATIONS

International Search Report for International Application No. PCT/EP2015/076141 dated Feb. 4, 2016, 2 pages.
Chinese Office Action for CN Application No. 201580064332.9 dated Jul. 2, 2018, 7 pages.

* cited by examiner

METHOD FOR OPERATING AN ELEVATOR SYSTEM AND ELEVATOR SYSTEM DESIGNED FOR PERFORMING THE METHOD

CROSS-REFERENCE TO RELATED APPLICATIONS

This application is a 371 U.S. National Stage of International Application No. PCT/EP2015/076141, filed Nov. 10, 2015, which claims priority to German Application No. 10 2014 017 487.5 filed on Nov. 27, 2014. The disclosure of each of the above applications is incorporated herein by reference in their entirety.

FIELD

The invention concerns a method for operating an elevator system which comprises a shaft system and at least three cars, which is designed for separately moving the cars in at least a first direction of travel and in a second direction of travel. The at least three cars are moved separately in sequential operation each time. For each car a stop point at which the car can stop if necessary is continuously predicted at least for one direction of travel.

BACKGROUND

Such an elevator system is in particular an elevator system which comprises one shaft in which a plurality of cars can be moved separately. In particular, at least one additional car can be moved above and below at least one car. In particular, this method of a plurality of cars substantially independent of each other in a shaft is a sequential operation in the sense of the present invention. In the prior art, such an elevator system is known for example from the document EP 1 562 848 B1.

Moreover, an elevator system as mentioned above is in particular an elevator system with a shaft system comprising a plurality of shafts, wherein the elevators can be moved in particular in a circulating mode as a sequential operation. The movement in a sequential operation occurs in particular in that several cars travel upward together in at least one shaft of the shaft system, travel from this shaft into at least one additional shaft and in this at least one additional shaft they travel downward together. In such an elevator system it is provided in particular that usually several cars are moved at any one time in each of the shafts of the shaft system. Such an elevator system is known in the prior art, for example from the document EP 0 769 469 B1.

The sequential operation of the cars of such elevator systems requires a particular design of the safety system of the elevator system, since a collision between cars must absolutely be prevented. In order to prevent a collision between cars, it is known, for example from the document WO 2004/043842 A1, how to monitor the absolute distances between the immediately neighboring cars. If the distance falls below a predefined value for a critical spacing between two cars, a measure is taken to avoid a collision of the cars. Such a measure may be the triggering of a safety mechanism of the car for example, especially the triggering of a catching device of the car.

According to document EP 0 769 469 B1, collisions between cars cannot be prevented simply by a large spacing. It is therefore proposed in document EP 0769 469B1 that each car has its own safety module in addition to its own drive unit. This safety module can trigger braking processes both for the corresponding car and for neighboring cars. The safety module computes from the current movement data of all cars of the elevator system the required braking behavior of the cars.

One problem known from EP 0 769 469 B1 is that the data volume required for this computation taking account of the current movement data is so large that an ongoing transmission and processing of this data is not possible, at least not with reasonable technical expense, so that EP 0 769 469B1 proposes working with a dynamic elevator model.

This means, for a decentralized safety system in which the spacing monitoring of the cars occurs locally at the cars, the above-described principle either involves an unmanageable communication burden between the safety modules of the cars of an elevator system. The technical expense in handling so large a communication burden can be realized at most with very large technical expense. Alternatively, elevator models which best approximate the actual elevator operation need to be developed and serve as the basis for the computations of the braking processes, which involves large expense. Furthermore, each time the model must be adapted to the actual circumstances, such as the respective number of cars for example.

Against this background, one problem of the present invention is to improve a method for the operation of an elevator system which comprises a shaft system and at least three cars, especially so that possible collisions of cars can be recognized early on, wherein the recognition should advantageously be done by means of a decentralized design of the safety system. Preferably, the data volume to be transmitted here should be as low as possible. Moreover, an easy transferability of the method to elevator systems of different design should preferably be possible.

SUMMARY

As the solution to the problem, a method is proposed for operating an elevator system which comprises a shaft system and at least three cars, which is designed for separately moving the cars in at least a first direction of travel and in a second direction of travel, wherein the at least three cars are moved separately in sequential operation each time and for each car a stop point at which the car can stop if necessary is continuously predicted at least for one direction of travel. The distance of the predicted stop points of neighboring cars from each other is continuously determined, wherein the elevator system is transferred to a safety mode if a negative distance of the stop points is determined. In particular, it is provided that the elevator system comprises at least one linear motor as its drive system, enabling a separate movement of the cars. That is, the cars can move in the shaft system largely independently of each other, taking into consideration the other cars each time. In particular, it is provided that the cars can be moved upward and downward each time and thus they are designed to move in at least a first direction of travel and in a second direction of travel. In particular, when the shaft system of the elevator system comprises several shafts, and the cars can be moved between the shafts through connecting shafts, lateral directions of travel are provided in particular as further directions of travel.

In particular, the method has the advantage that each time the stop point is calculated in an ongoing manner, that is, substantially continuously, for each car for the at least one direction of travel. This stop point in particular provides information as to where this car would stop or come to a halt upon braking, especially an emergency braking. Operating parameters of the other cars, especially movement parameters of the other cars, advantageously need not be considered in this determination of the stop points. By the comparing of a stop point of one car for one direction of travel with the stop point of a neighboring car, a danger of collision can advantageously be reliably recognized. Thus, in this method, advantageously only stop points are transmitted and in particular no further operating parameters relating to the car, so that the data volume to be transmitted is advantageously low. Since in particular it is provided that only the stop points of neighboring cars are compared with each other, advantageously the data volume to be transmitted is further reduced.

A current stop point for one direction of travel of a car is, in particular, the distance needed by the car to stop in this direction of travel, starting from the current position of the car, i.e., the predicted braking distance in particular. Preferably, the distance is given a safety margin, preferably a fixed safety margin, so that the stop point lies accordingly further away from the car. Depending on the current operating parameters of a car of the elevator system, the distance between the car and the stop point thus also changes each time for each direction of travel. In particular, the distance of the corresponding stop point from the car also increases with the speed at which a car is moving.

The minimum distance which two neighboring cars can assume in relation to one another is dependent on several operating parameters, especially the current position of the cars in the shaft system, the speed of the cars, the acceleration of the cars, the loading capacities of the cars and/or the conditions of the brakes of the cars. Advantageously, in the method according to the invention, these operating parameters are detected each time individually only for each car in order to determine from these operating parameters the respective stop point for each car for the at least one direction of travel. By the comparing of the stop points of neighboring cars, a check is advantageously made as to the maintaining of a minimum spacing between the cars, this minimum spacing being advantageously dynamically adapted by the ongoing determinations of the stop points and their comparison.

If, upon determining the distances of the predicted stop points of neighboring cars, a negative distance is determined, that is, if the stop point of one car is further away from this car than the stop point of a neighboring car, the elevator system is advantageously transferred to a safety mode, in particular in which the corresponding neighboring cars whose stop points show a negative distance are braked and thus brought to a halt, especially by a triggering of safety mechanisms of these cars. It should be pointed out that the term "negative distance" means the case when the stop point of a particular car lies further away from this particular car than the stop point of a neighboring car, especially a car lying ahead or coming from behind. Whether the distance is in fact negative in the sense of a negative number depends on the reference system used. Thus, a "negative distance" can also in particular be expressed by a positive number for a corresponding reference system.

Advantageously, the method can be applied in particular to both horizontal and vertical movements of the cars. Furthermore, advantageously, the proposed method provides a rapid recognition of possible collisions between neighboring cars.

According to an especially advantageous embodiment of the method according to the invention, it is provided that the stop point of each car is predicted each time under the assumption of the stopping of the respective car at latest upon engagement of at least one safety mechanism of the elevator system. Thus, advantageously, the method is conservative in nature. For this reason the distance between neighboring cars may at times be larger than absolutely necessary, but a collision of neighboring cars is reliably prevented. Safety mechanisms of the elevator system in this case are in particular braking devices, such as catching devices of the cars and/or braking devices provided on the part of the drive system. If the drive system of the elevator system comprises at least one linear drive, the switching off in sections of one branch of the linear drive is also provided in particular as an engagement of at least one safety mechanism.

Another advantageous embodiment of the invention provides that the stop points are predicted each time under the assumption of a worst case scenario, in order to reliably prevent a collision of neighboring cars in every instance. In particular, it is provided that the stop point of each car is predicted under the additional assumption that the respective car is accelerated with the maximum possible acceleration on the part of the elevator system before the engaging of the at least one safety mechanism of the elevator system. For a car being halted which can be moved upward and downward in a shaft, the stop point in the "up" direction of travel is thus advantageously predicted under the assumption that the car is at first accelerated to the maximum in the "up" direction of travel and then brought to a stop by an engagement of at least one safety mechanism. In the "down" direction of travel the stop point in the "down" direction of travel is advantageously predicted under the assumption that the car is at first accelerated to the maximum in the "down" direction of travel and then brought to a stop by an engagement of at least one safety mechanism. On account of the gravity acting on the car, which is advantageously included in the prediction of the stop points, the distance of the stop point in the "up" direction of travel from the upper end of the car is less than the distance of the stop point in the "down" direction of travel from the lower end of the car.

According to an especially advantageous embodiment of the method according to the invention, a first stop point is predicted for each car for the first direction of travel and a second stop point is predicted for each car for the second direction of travel, so that two stop points are predicted continuously for each car. Advantageously, at least one upper stop point for the "up" direction of travel and one lower stop point for the "down" direction of travel is predicted for each car.

For each car having a neighboring first car in the first direction of travel, advantageously the distance from the first stop point of this car to the second stop point of the first car is determined, especially in order to be able to ascertain a risk of collision of this car with the first car.

For each car having a neighboring second car in the second direction of travel, advantageously the distance from the second stop point of this car to the first stop point of the second car is determined, especially in order to be able to ascertain a risk of collision of this car with the second car.

In particular, it is provided that, in a vertically running shaft of the shaft system of the elevator system in which at least three cars are traveling, an upper stop point and a lower stop point are predicted continuously for each car. Thus, except for the car situated uppermost in the shaft and the car situated lowermost in the shaft, all cars will have an upper neighboring car and a lower neighboring car. It is provided advantageously that each time the distance from the upper stop point of a car to the lower stop point of the upper neighboring car is determined.

Advantageously, moreover, the distance from the lower stop point of a car to the upper stop point of the lower neighboring car is determined.

The stop points are advantageously defined via a grid permanently assigned to the shaft system. A grid basically suitable for this is known, for example, from the document EP 1 719 727 B1.

In such a fixed grid, the lowest point which a car can reach via the shaft system is preferably assigned the value of 0. The highest point which a car can reach via the shaft system is preferably assigned a corresponding highest value. If the cars can also move laterally, the stop points can be represented in particular as coordinates (x, y) or (x, y, z). Preferably, for a current direction of travel, only the corresponding coordinates are considered, such as only the x coordinate for direction of travel x. In particular in regions in which the direction of travel changes, for example from direction of travel x to direction of travel y, it is advantageously provided that more than one coordinate is considered here each time for a corresponding section including the transition region, i.e., the coordinates (x, y) in regard to the previously mentioned example.

In a fixed grid established in this way there is a collision danger if the upper stop point of a car is greater than the lower stop point of the car traveling above this car. In this case, the elevator system is transferred to a safety mode, especially by bringing at least one of the two cars to a stop. The same holds accordingly if the lower stop point of a car is less than the upper stop point of the car traveling below this car.

Possible collision dangers of a car with an upper neighboring car and/or a lower neighboring car are thus reliably recognized, namely, by checking to see whether a determined distance is negative, i.e., the stop points being compared with each other have an intersection region. If a negative distance is determined, the elevator system is advantageously transferred from the normal operation to a safety mode, especially by halting the affected cars. The other cars advantageously continue to move in restricted operation, the halted cars defining a barrier zone which the still operating cars may only approach to within a predefined distance. Preferably, the cars halted in the course of the transfer of the elevator system to a safety mode are given permanently assigned stop points, so that in particular a collision of cars with the halted cars continues to be prevented by use of the same method.

According to an especially advantageous embodiment of the method according to the invention it is provided that the cars each have their own control unit, the control unit of a car of the elevator system each time predicts the stop point for the at least one direction of travel and each time the stop points predicted for a car are transmitted to the control units of the neighboring cars to this car, wherein the control unit of a car each time ascertains the distance of the stop points predicted for this car from the stop points transmitted to this control unit.

The required volume of real-time data to be transmitted is advantageously small. Advantageously, the stop points can be calculated at the same time by several control units which are advantageously arranged each time on the cars. This advantageously lowers the technical requirements on the real-time capacities of the safety system of the elevator system.

The control units which are assigned each time to a car and preferably are arranged on the car detect all operating parameters needed for the prediction of the stop points advantageously by corresponding sensors arranged on the car. This includes in particular the current position of the car, the speed of the car, the acceleration of the car, the loading capacity of the car and/or the condition of the brakes of the car. These operating parameters as well as the stop points predicted from them are preferably ascertained at predefined discrete intervals of time of, for example, 5 ms to 50 ms (ms: milliseconds). This makes possible a virtually ongoing prediction of the stop points.

Each control unit assigned to a car advantageously calculates the stop points for the at least one direction of travel of this car, especially an upper and a lower stop point, and exchanges these with those of the control units of the neighboring cars. Instead of calculating the distances between neighboring cars, advantageously the stop points are compared to each other, as already explained above. As long as the stop points do not overlap, that is, no negative distance is determined, no collision danger exists.

Preferably, the control unit of a car upon determining a negative distance of the stop points triggers a safety mechanism of this car, it being provided in particular that a triggering of the safety mechanism brings the car to a halt. In particular, the activating of a brake of the car is provided as the triggering of a safety mechanism of the car. Advantageously, the control unit assigned to a car in regard to the triggering of safety mechanisms is responsible only for the safety mechanism of this car and also advantageously need not brake other cars. In this way, the data volume to be transmitted is also advantageously further reduced.

In particular, it is provided that the stop points are predicted each time from current operating parameters of the respective car. According to one advantageous variant embodiment, it is provided that stop points are predefined each time for all quantized combinations of operating parameters. A coordinating of the stop points to such a combination of operating parameters is done through lookup tables according to one advantageous embodiment. In particular, according to another advantageous variant embodiment, such a coordination is provided as a plausibility check on stop points predicted by real-time computations. Advantageously, the elevator system is likewise transferred to a safety mode upon determining a predefined deviation of coordinated stop points and predicted stop points.

According to another advantageous aspect of the invention it is provided that the elevator system comprises a decentralized safety system with a plurality of control units, wherein the plurality of control units comprise the control units of the cars, and the control units each time exchange data for the determination of an operating mode deviating from the normal operation of the elevator system.

In order to solve the above-mentioned problem there is furthermore proposed an elevator system designed to implement a method according to the invention. In particular, an elevator system is proposed with a shaft system comprising at least one shaft and at least three cars, which together can move separately in the at least one shaft of the shaft system, wherein the cars advantageously each comprise their own control unit, and wherein the elevator system is designed to implement a method according to the invention.

In particular, it is provided that the control units of the cars are interconnected by an interface for the transmission of data. As the interface, a communication bus is proposed in particular. According to another advantageous embodiment, the data transmission is wireless, especially via an air interface, such as by means of WLAN (WLAN: Wireless Local Area Network). Each control unit of a car is advantageously designed to ascertain the stop points for this car and to compare them against the transmitted stop points of neighboring cars. For the determination of the stop points, each car advantageously comprises sensors for the detecting of operating parameters, such as in particular speed, acceleration, loading capacity, condition of the safety mechanisms of the car, especially condition of the brakes as a safety mechanism of the car, and position of the car. The detected operating parameters are transmitted to the control unit and evaluated by it for the prediction of the stop points.

BRIEF DESCRIPTION OF THE FIGURES

Further advantages, features, and design details of the invention shall be explained more closely in conjunction with the sample embodiments shown in the figures. There are shown.

DETAILED DESCRIPTION

Figure 1:
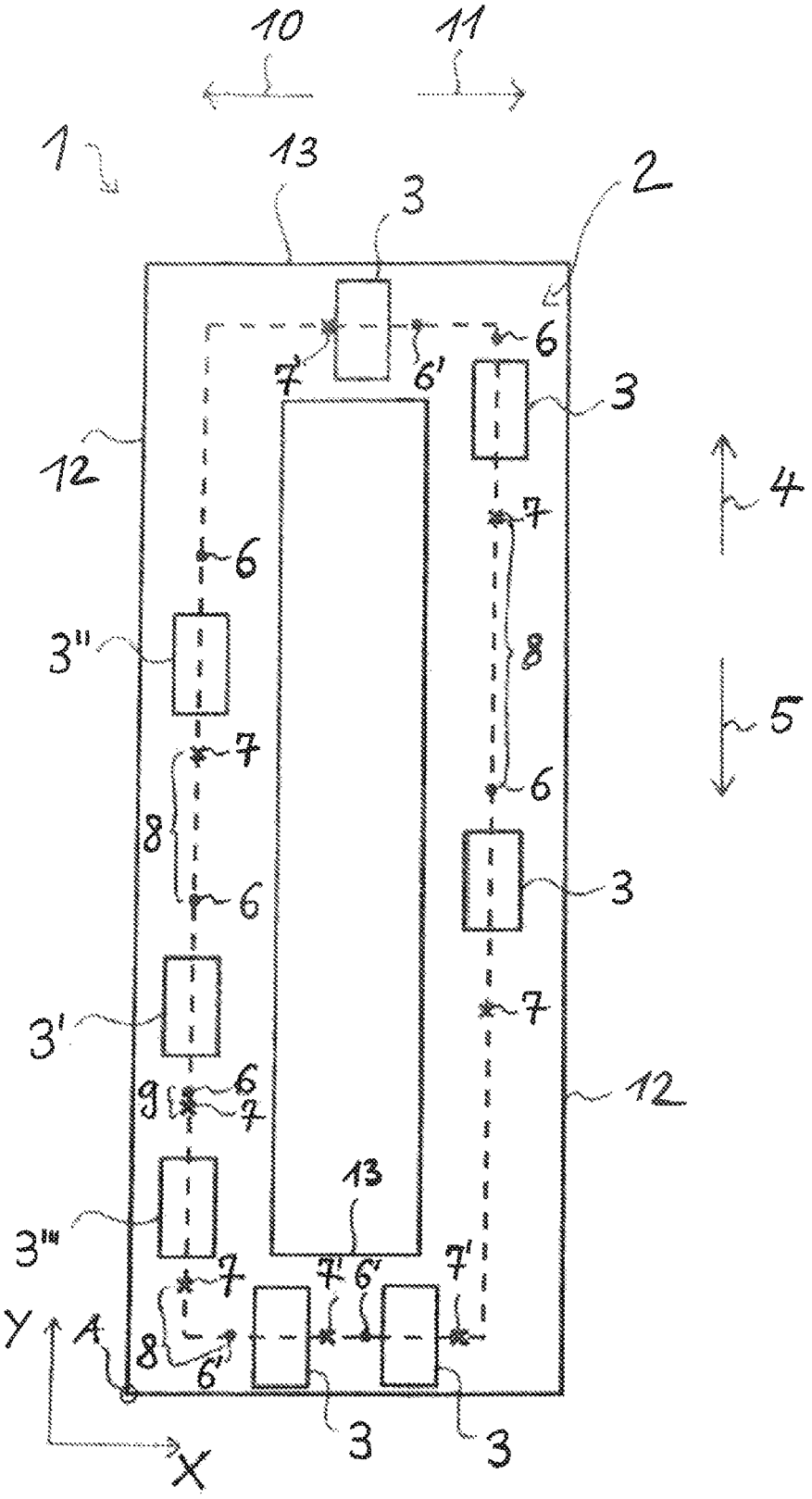
FIG. 1 in a simplified schematic representation, a sample embodiment of an elevator system, which is operated according to a variant embodiment of a method according to the invention.

The elevator system 1 represented in FIG. 1, which for reasons of clarity is not drawn true to scale, comprises a shaft system 2 with two vertical shafts 12 and two connecting shafts 13. Furthermore, the elevator system 1 comprises a plurality of cars 3 (eight cars for example in FIG. 1), which can be moved separately in a sequential operation in the shaft system 2, that is, several cars 3 can be moved in a shaft 12 or a shaft 13.

The cars 3 can move upward in the shafts 12 in a first direction of travel 4 (shown symbolically in FIG. 1 by the arrow 4) and downward in a second direction of travel 5 (shown symbolically in FIG. 1 by the arrow 5). In the connecting shafts 13, by which the cars 3 can switch between the shafts 12, the cars are furthermore laterally movable in a third direction of travel 10 (shown symbolically in FIG. 1 by the arrow 10) and in a fourth direction of travel 11 (shown symbolically in FIG. 1 by the arrow 11).

In particular, it is provided that the elevator system comprises, as its drive system, at least one linear motor (not shown explicitly in FIG. 1), by means of which the cars 3 travel within the shaft system 2.

The elevator system 1 represented in FIG. 1 is operated in such a way that, for each car 3, in ongoing fashion a first stop point 6 is predicted for the first possible direction of travel and a second stop point 7 for the second possible direction of travel. Thus, for each car 3 a stop point is predicted in ongoing fashion for at least one direction of travel. Thus, for cars 3 located in the vertical shafts 12 an upper stop point is predicted as the first stop point 6 and a lower stop point is predicted as the second stop point 7. In the connecting shafts 13, a stop point located in the direction of travel of the respective car 3 is predicted as the stop point 6' and a second stop point located opposite the direction of travel of the respective car 3 is predicted as the stop point 7'.

The stop points can be defined in particular by coordinates (x, y), wherein lateral stop points are defined by the x-coordinates and vertically situated stop points by the y-coordinates. For example, the coordinates (0, 0) can be assigned to the point A in FIG. 1 for example.

The two stop points 6, 7 or 6',7' indicate for each of the possible direction of travel s 4, 5 or 10, 11, starting from the current position of the respective car 3, each time the point at which the car 3 can stop at latest, assuming a worst case scenario. In particular, for a car 3' moving upward, taking into account current operating parameters such as for example the direction of travel, speed, and loading capacity of the car 3', an upper stop point 6 is predicted, i.e., determined in advance, where the car 3' would stop if the car 3' were accelerated to the maximum in the direction of travel and then braked. As the lower stop point 7 of the car 3', under the worst case assumption, it is predicted that the drive fails, the car 3' as a result of this slumps down, and only then is the car 3' braked.

Corresponding predictions are done in ongoing manner for the other cars 3 of the lift system. Advantageously the cars 3 comprise a control unit for this, for example, a microcontroller circuit designed as a control unit (not explicitly shown in FIG. 1).

For each car 3 having a neighboring first car in a first direction of travel, the distance from the first stop point 6 of this car to the second stop point 7 of the second car is determined. Furthermore, for each car 3 which has a neighboring second car in the second direction of travel, the distance from the second stop point 7 of this car to the first stop point 6 of the second car is determined.

For example, for the car 3' which has a neighboring car 3" in direction of travel 4, the distance 8 from the upper stop point 6 of the car 3' to the lower stop point 7 of the car 3" is determined. For this, advantageously the lower stop point 7 of the car 3" is transmitted to a control unit (not explicitly shown in FIG. 1) of the car 3'. The distance 8 so determined is positive in this example. Thus, no collision danger exists in regard to the cars 3' and 3".

The car 3' furthermore has a neighboring car 3''' in the other direction of travel 5. Therefore, the distance 9 from the lower stop point 7 of the car 3' to the upper stop point 6 of the car 3''' is furthermore determined for the car 3'. For this, advantageously the upper stop point 6 of the car 3''' is transmitted to a control unit (not explicitly shown in FIG. 1) of the car 3'. The distance 9 so determined is negative in this example, that is, the upper stop point 6 of the car 3''' lies above the lower stop point 7 of the car 3'. Thus a collision danger exists in regard to the cars 3' and 3'''. On account of the negative distance 9 of the lower stop point 6 of the car 3' and the upper stop point 7 of the car 3''', the elevator system is transferred to a safety mode, especially by activating a car-side braking of these cars, preferably triggered by the control units coordinated with the respective cars 3' and Since each time only one stop point is transmitted to a car 3 from the two neighboring cars, the communication load in the method applied is advantageously slight.

Figure 2:
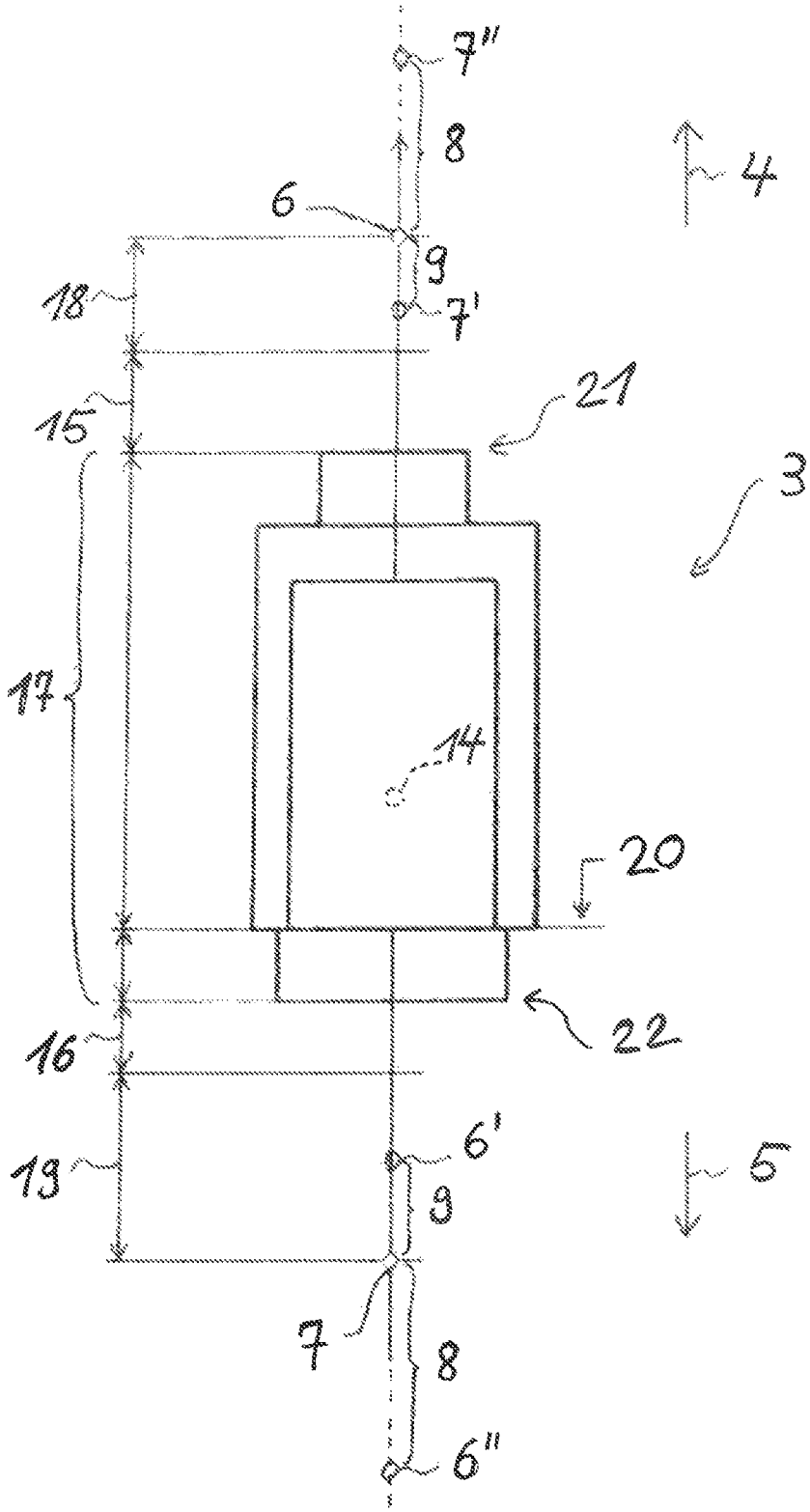
FIG. 2 in a simplified schematic representation, a sample embodiment of a car for use in an elevator system represented in FIG. 1, with example stop points shown.

For a further explanation of the stop points which are predicted for a car 3 according to a method of the invention, refer to FIG. 2. FIG. 2 shows a car 3 with an overall car height 17 and an entry threshold 20.

For the car 3 which can move in direction of travel 4 and in direction of travel 5 (in FIG. 2 the direction of travel is shown symbolically by arrows 4, 5), each time a predicted stop point 6, 7 is shown for each direction of travel 4, 5 for example. For the direction of travel 4, the upper stop point 6 is shown, and for the direction of travel 5 the lower stop point 7.

The upper stop point 6 indicates the point where the car 3 can stop at latest in the direction of travel 4 with the upper car end 21, based on current operating parameters and assuming a worst case scenario. The distance between the stop point 6 and the upper car end 21 in the sample embodiment depicted results from the sum of an optionally established minimum distance 15 to the car 3, which must not be crossed, and a braking distance 18 calculated from the current travel parameters assuming a worst case scenario. The calculation of the stop points is done for example by means of a correspondingly configured predictor model.

The lower stop point 7 on the contrary indicates the point where the car 3 can stop at latest in the direction of travel 5 with the lower car end 22, based on current operating parameters and assuming a worst case scenario. The distance between the stop point 7 and the lower car end 22 in the sample embodiment depicted results from the sum of an optionally established minimum distance 16 to the lower car end 22, which must not be crossed, and a braking distance 19 calculated from the current travel parameters assuming a worst case scenario.

The positions of the stop points vary in dependence on the current respective operating parameters. If the car is halted, the stop points will move closer to the car. If the car is traveling upward at high speed, i.e., in direction of travel 4, the upper stop point will lie further above. In particular, even at very high speed the case may occur that the lower stop point 7 will be determined lying at position 14, since in this case a movement in the direction of travel 5 can be ruled out, even in the worst case scenario.

For each such car 3 as represented in FIG. 2, each time such an upper stop point and a lower stop point is predicted. Each time the distance between the upper stop point 6 of a car and the lower stop point 7' or 7" of a neighboring car located above this car and the distance between the lower stop point 7 of this car and the upper stop point 6' or 6" of a neighboring car located below this car is determined. During a non-critical operation, the distances 8 are positive, since 7" is greater than 6 and 7 is greater than 6". In the case of a negative distance, on the other hand, there is a collision risk. Such a negative distance occurs if 6 is greater than 7' or 6' is greater than 7. If such a negative distance is determined, the elevator system will be transferred to a safe operating state, especially to a safety mode.

The sample embodiments represented in the figures and explained in connection with them serve to explain the invention and are not limiting to it.

LIST OF REFERENCES

1 Elevator system
2 Shaft system
3 Car
3' Car
3" Car
3'" Car
4 First direction of travel
5 Second direction of travel
6 First stop point
6' First stop point
6" First stop point
7 Second stop point
7' First stop point
7" First stop point
8 Positive distance of predicted stop points
9 Negative distance of predicted stop points
10 Third direction of travel
11 Fourth direction of travel
12 Vertical shaft
13 Connecting shaft
14 Extreme position for a possible stop point
15 Minimum distance to be maintained from the car
16 Minimum distance to be maintained from the car
17 Car height
18 Predicted braking distance
19 Predicted braking distance
20 Entry threshold
21 Upper end of car
22 Lower end of car

The invention claimed is:

1. A method for operating an elevator system which comprises a shaft system and at least three cars, the elevator system configured for separately moving the cars in at least a first direction of travel and in a second direction of travel, the method comprising:

moving the at least three cars separately and sequentially;

continuously predicting a stop point for each car of the at least three cars for at least one direction of travel;

continuously determining a distance of the predicted stop points of neighboring cars from each other of the at least three cars; and transferring the elevator system to a safety mode based on a negative distance of the stop points being determined.

2. The method of claim 1, further comprising:

predicting a stop point of each car of the at least three cars under an assumption of the stopping of the respective car at latest upon engagement of at least one safety mechanism of the elevator system.

3. The method of claim 2, further comprising:

predicting a stop point of each car under an additional assumption that the respective car is accelerated with the maximum possible acceleration on the part of the elevator system before the engaging of the at least one safety mechanism of the elevator system.

4. The method of claim 1, further comprising:

predicting for each car a first stop point for the first direction of travel; and predicting for each car a second stop point for the second direction of travel such that two stop points are predicted continuously for each car.

5. The method of claim 4, further comprising:

determining a distance for each car having a neighboring first car in the first direction of travel from the first stop point of the car to the second stop point of the neighboring first car.

6. The method of claim 5, further comprising:

determining a distance for each car having a neighboring second car in the second direction of travel from the second stop point of the car to the first stop point of the neighboring second car.

7. The method of claim 1 wherein each car of the elevator system has their own control unit, the method further comprising:

predicting, with the respective control unit of a first car, a stop point for the at least one direction of travel;

transmitting predicted stop points for each car of the at least three cars to control units of neighboring cars of the at least three cars; and ascertaining, with the respective control unit of an identified car, a distance of the stop points predicted for the first car from the stop points transmitted to the control unit of the first car.

8. The method of claim 7, further comprising:

triggering a safety mechanism of an identified car upon determining a negative distance of the stop points with the respective control unit; and bringing the identified car to a halt based on the triggering.

9. The method of claim 8 wherein the stop points are predicted each time from current operating parameters of the respective car.

10. The method of claim 8 wherein the elevator system comprises a decentralized safety system with a plurality of control units, wherein the plurality of control units comprise the control units of the cars, the method further comprising:

exchanging data with the control units; and determining an operating mode deviating from normal operation of the elevator system.

11. An elevator system comprising:

a shaft system having at least one shaft;

at least three cars that move separately in at least a first direction of travel and in a second direction of travel in the at least one shaft of the shaft system;

a control unit associated with each car of the at least three cars;

wherein the at least three cars are moved separately in sequential operation, wherein a stop point at which each car can stop if necessary is continuously predicted at least for one direction of travel of the first and second directions of travel;

wherein a distance of the predicted stop points of neighboring cars from each other is continuously determined and the elevator system is transferred to a safety mode based on a negative distance of the stop points is determined.

12. The elevator system of claim 11 wherein the stop point of each car is predicted each time under the assumption of the stopping of the respective car at latest upon engagement of at least one safety mechanism of the elevator system.

13. The elevator system of claim 12 wherein the stop point for each car is predicted under the additional assumption that the respective car is accelerated with the maximum possible acceleration on the part of the elevator system before the engaging of the at least one safety mechanism of the elevator system.

14. The elevator system of claim 13 wherein a control unit of an identified car of the elevator system each time predicts the stop point for the at least one direction of travel and each time the stop points predicted for the identified car are transmitted to the control units of the neighboring cars.

15. The elevator system of claim 14 wherein stop points of neighboring cars are transmitted to the identified car and wherein the control unit of the identified car ascertains the distance of the stop points predicted for the identified car from the stop points transmitted to the control unit of the identified car.

16. A method for operating an elevator system which comprises a shaft system and at least three cars, the elevator system configured for separately moving the cars in at least a first direction of travel and in a second direction of travel, the method comprising:

moving the at least three cars separately and sequentially;

continuously predicting a first stop point for each car of the at least three cars for the first direction of travel;

predicting for each car a second stop point for the second direction of travel such that two stop points are predicted continuously for each car;

continuously determining a distance of the predicted stop points of neighboring cars from each other of the at least three cars; and transferring the elevator system to a safety mode based on a negative distance of the stop points being determined.

17. The method of claim 16 wherein the negative distance is present if the stop point of a first car of the at least three cars is further away from the first car than a corresponding stop point of a neighboring car of the neighboring cars.

18. The method of claim 16, further comprising:

predicting a stop point of each car of the at least three cars under an assumption of the stopping of the respective car at latest upon engagement of at least one safety mechanism of the elevator system.

19. The method of claim 18, further comprising:

predicting a stop point of each car under an additional assumption that the respective car is accelerated with the maximum possible acceleration on the part of the elevator system before the engaging of the at least one safety mechanism of the elevator system.

* * * * *